US011274526B2

(12) United States Patent
Deville et al.

(10) Patent No.: US 11,274,526 B2
(45) Date of Patent: Mar. 15, 2022

(54) SYSTEM AND METHOD FOR ELECTRO-HYDRAULIC ACTUATION OF DOWNHOLE TOOLS

(71) Applicant: SCHLUMBERGER TECHNOLOGY CORPORATION, Sugar Land, TX (US)

(72) Inventors: Benoit Deville, Rosharon, TX (US); Srinivas Poluchalla, Katy, TX (US); Virinchi Mallela, Novi, MI (US); Marian Faur, Clamart (FR); Charley Martinez, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/760,853

(22) PCT Filed: Oct. 30, 2018

(86) PCT No.: PCT/US2018/058069
§ 371 (c)(1),
(2) Date: Apr. 30, 2020

(87) PCT Pub. No.: WO2019/089487
PCT Pub. Date: May 9, 2019

(65) Prior Publication Data

US 2021/0215020 A1 Jul. 15, 2021

Related U.S. Application Data

(60) Provisional application No. 62/579,547, filed on Oct. 31, 2017.

(51) Int. Cl.
*E21B 23/04* (2006.01)
*E21B 34/16* (2006.01)
(Continued)

(52) U.S. Cl.
CPC ..... *E21B 34/16* (2013.01); *E21B 23/04* (2013.01); *E21B 34/14* (2013.01); *F15B 15/20* (2013.01); *F15B 21/08* (2013.01); *E21B 2200/05* (2020.05)

(58) Field of Classification Search
CPC ..... E21B 23/0419; E21B 23/04; E21B 34/16; E21B 34/14
See application file for complete search history.

(56) References Cited

U.S. PATENT DOCUMENTS 4,161,219 A 7/1979 Pringle
4,660,646 A 4/1987 Blizzard
(Continued)

FOREIGN PATENT DOCUMENTS

WO 9115692 A1 10/1991

OTHER PUBLICATIONS

International Search Report and Written Opinion issued in the PCT Application PCT/US2018/058069, dated Feb. 22, 2019 (16 pages).
(Continued)

*Primary Examiner* — Cathleen R Hutchins
(74) *Attorney, Agent, or Firm* — Matthew Goode

(57) ABSTRACT

A technique facilitates wellbore operations and utilization of wellbore equipment, e.g. equipment comprising actuation devices for downhole tools. According to an embodiment, the system comprises a pump solution for an electrically control device, e.g. an electrically controlled valve. The system may comprise hydraulic circuitry which utilizes bellows to effectively enclose the hydraulic circuitry. Consequently, the system enables an electrically control downhole system having components hydraulically actuated via a closed loop hydraulic system.

16 Claims, 11 Drawing Sheets

(51) Int. Cl.

| | |
|---|---|
| ***E21B 34/14*** | (2006.01) |
| ***F15B 15/20*** | (2006.01) |
| ***F15B 21/08*** | (2006.01) |

(56) References Cited

U.S. PATENT DOCUMENTS

| | | | | |
|---|---|---|---|---|
| 6,059,539 | A | 5/2000 | Nyilas et al. | |
| 6,364,023 | B1 | 4/2002 | Hiron et al. | |
| 2008/0264646 | A1 | 10/2008 | Sten-Halvorsen et al. | |
| 2009/0266555 | A1 | 10/2009 | May et al. | |
| 2010/0006295 | A1 | 1/2010 | Goughnour et al. | |
| 2010/0139923 | A1 | 6/2010 | Biddick | |
| 2011/0186303 | A1* | 8/2011 | Scott | E21B 34/066 166/373 |
| 2013/0206387 | A1* | 8/2013 | Deville | E21B 41/00 166/66.4 |
| 2016/0245425 | A1 | 8/2016 | Heyn | |
| 2017/0254177 | A1* | 9/2017 | Woodford | E21B 34/10 |

OTHER PUBLICATIONS

International Preliminary Report on Patentability issued in the PCT Application PCT/US2018/058069, dated May 14, 2020 (12 pages).

* cited by examiner

SYSTEM AND METHOD FOR ELECTRO-HYDRAULIC ACTUATION OF DOWNHOLE TOOLS

CROSS-REFERENCE TO RELATED APPLICATION

The present document is based on and claims priority to U.S. Provisional Application Ser. No. 62/579,547, filed Oct. 31, 2017, which is incorporated herein by reference in its entirety.

BACKGROUND

Hydrocarbon fluids such as oil and natural gas are obtained from a subterranean geologic formation, referred to as a reservoir, by drilling a wellbore that penetrates the hydrocarbon-bearing formation. Once the wellbore is drilled, various forms of well completion components may be installed to control and enhance the efficiency of producing the various fluids from the reservoir. In some wells, for example, valves are actuated between open and closed states to compensate or balance fluid flow across multiple zones in the wellbore. In other wells, an isolation valve may be actuated to a closed position to shut in or suspend a well for a period of time and then opened when desired. Often a well includes a subsurface valve to prevent or limit the flow of fluids in an undesired direction.

SUMMARY

In general, a system and methodology are provided which relate to wellbore operations and equipment, e.g. operations and equipment comprising actuation devices for downhole tools. According to an embodiment, the system comprises a pump solution for an electrically control device, e.g. an electrically controlled safety valve. The system may comprise hydraulic circuitry which utilizes bellows to effectively enclose the hydraulic circuitry. Consequently, the system enables an electrically controlled downhole system having components hydraulically actuated via a closed loop hydraulic system.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a well system and methodology related to wellbore operations and equipment. For example, the well system and methodology may utilize electro-hydraulic actuation devices for use in actuating downhole tools without routing hydraulic lines from the surface. According to an embodiment, a system comprises a pump solution for an electrically controlled device, e.g. an electrically controlled valve. The system may comprise hydraulic circuitry which operates in response to electric control signals and utilizes bellows to effectively enclose the hydraulic circuitry. Consequently, the system enables an electrically controlled downhole system having components hydraulically actuated via a closed loop, metal enclosed, hydraulic system.

In at least some downhole applications, subsurface valves may be actuated to a first position, e.g. an open position, by application of hydraulic pressure and biased to a second position, e.g. a closed position, by a biasing mechanism, e.g. an enclosed pressurized fluid chamber or a mechanical spring. In some examples, the hydraulic pressure may be applied to a piston and cylinder assembly that acts against the biasing force of the biasing mechanism to open and hold the valve in the open position. However, the biasing force acts on the piston to bias the piston toward the second position. The biasing force is able to move the piston to the second position, e.g. a closed position, when the hydraulic pressure is reduced below a certain value. Control over the application of hydraulic pressure is achieved electrically, e.g. via an electrical control system.

According to one embodiment, an electrically controlled Surface Control Subsurface Safety Valve system is provided. In this example, the system may be split into two subsystems, namely an actuation system and a flapper system. The actuation system may be based on a motor driven hydraulic pump which delivers high pressure hydraulic fluid to move a piston rod which, in turn, is able to selectively open an attached flapper system. The actuation system may be constructed with a variety of electronics, sensors, and seals, e.g. metal seals, combined with a closed loop hydraulic fluid system which utilizes bellows and a pump. The flapper system may be constructed in a variety of forms and one example is the SlimTech™ flapper system available from the Schlumberger corporation.

Figure 1:
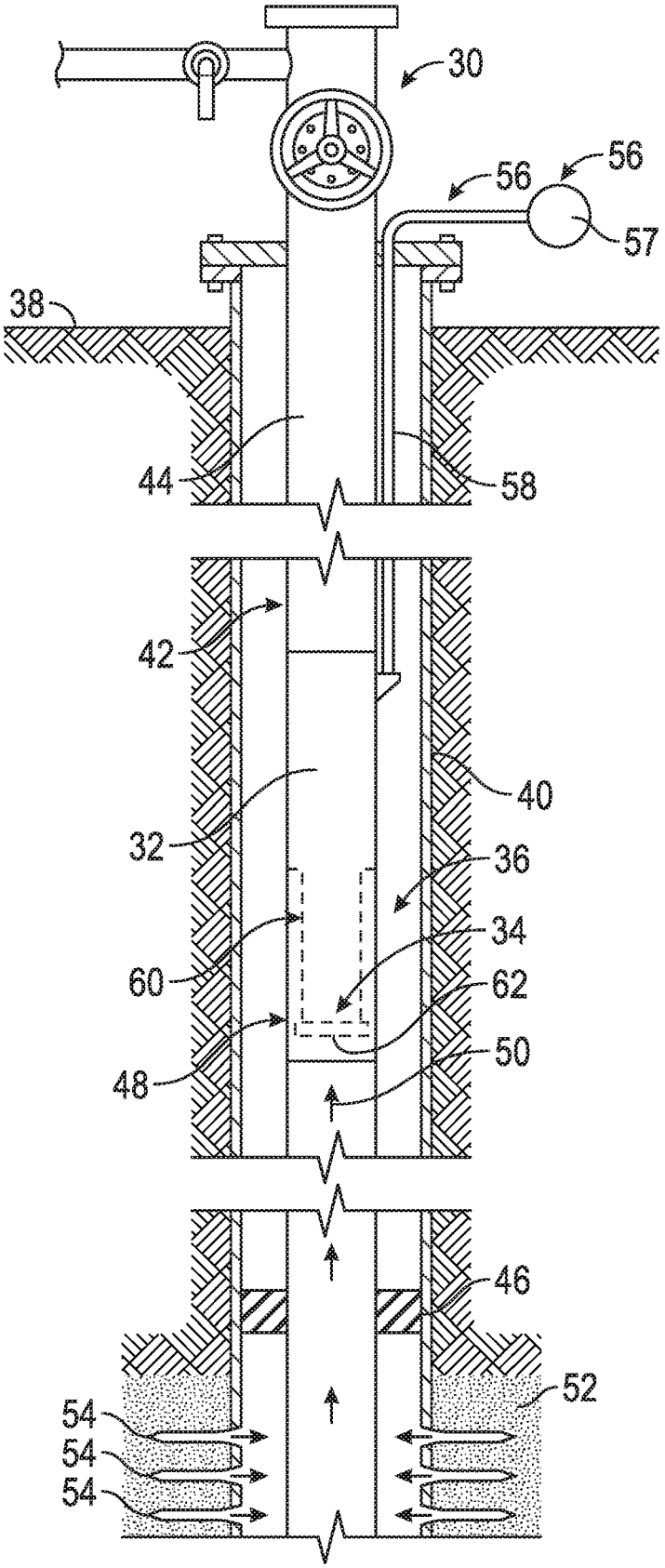
FIG. 1 is an illustration of an example of a well system having a downhole valve with a biased valve closure member, according to an embodiment of the disclosure.

Referring generally to FIG. 1, an embodiment of a well system 30 is illustrated. In this example, the well system 30 comprises a downhole device 32 having a fluid flow control member 34. The well system 30 may be deployed in a borehole 36, e.g. a wellbore, extending from a surface 38. The borehole 36 may be lined with a casing 40. Additionally, the well system 30 may comprise a tubing string 42 disposed in the borehole 36 and having various types of downhole equipment, such as tubing 44 and a packer 46. By way of example, the tubing string 42 may be a downhole completion string.

The downhole device 32 may comprise various configurations, but one embodiment is in the form of a subsurface flow control device 48, e.g. a valve, connected with tubing 44. The valve 48 may be operated for selectively controlling fluid flow through the downhole device 32 and through tubing string 42. By way of example, the valve 48 may be operated to selectively block flow of a reservoir fluid 50 when in a closed position and to allow flow of the reservoir fluid 50 to the surface 38 when in an open position. In production operations, the reservoir fluid 50, e.g. oil and/or gas, may flow from a surrounding formation 52 and through perforations 54 to an interior of the tubing string 42 for production to the surface 38.

According to an embodiment, the valve 48 may be actuated to an open position in response to a signal, e.g. an electric signal, provided via a control system 56, e.g. a surface control system. However, other types of signals, e.g. optical signals, also may be utilized to enable controlled actuation of valve 48 (or other type of controlled device). In the embodiment illustrated, the control system 56 comprises a power source 57 and is operationally connected, via a control line 58, to an actuator system 60, e.g. a closed loop hydraulic actuator system. The control line 58 may comprise an electric line or other suitable control line to carry signals from control system 56 to actuator system 60 to enable control over the valve/device 48. According to an example, valve 48 may be a flapper type valve and the actuator system 60 may be coupled with a flapper 62 to enable selective actuation of the flapper 62 between positions. Depending on the application, the control system 56 may be in the form of a computer-based control system, e.g. a microprocessor-based control system, a programmable logic control system, or another suitable control system for providing desired control signals to and/or from the downhole hydraulic system 60. The control signals may be in the form of electric power and/or data signals delivered downhole to system 60 and/or uphole from system 60.

In FIG. 1, the flapper 62 is illustrated in a closed position blocking flow of fluid 50 through the interior of the tubing string 42. As described in greater detail below, the flapper 62 may be actuated via the closed loop hydraulic system 60 controlled by electric signals provided via control system 56. Within the closed loop hydraulic system 60, hydraulic pressure may be maintained above a certain level to hold the flapper 62 in an open position. To actuate the valve 48 and flapper 62 to a closed position, the hydraulic pressure is reduced below a certain level, e.g. below a level which allows the flapper 62 to be spring biased to the closed position.

Figure 2:
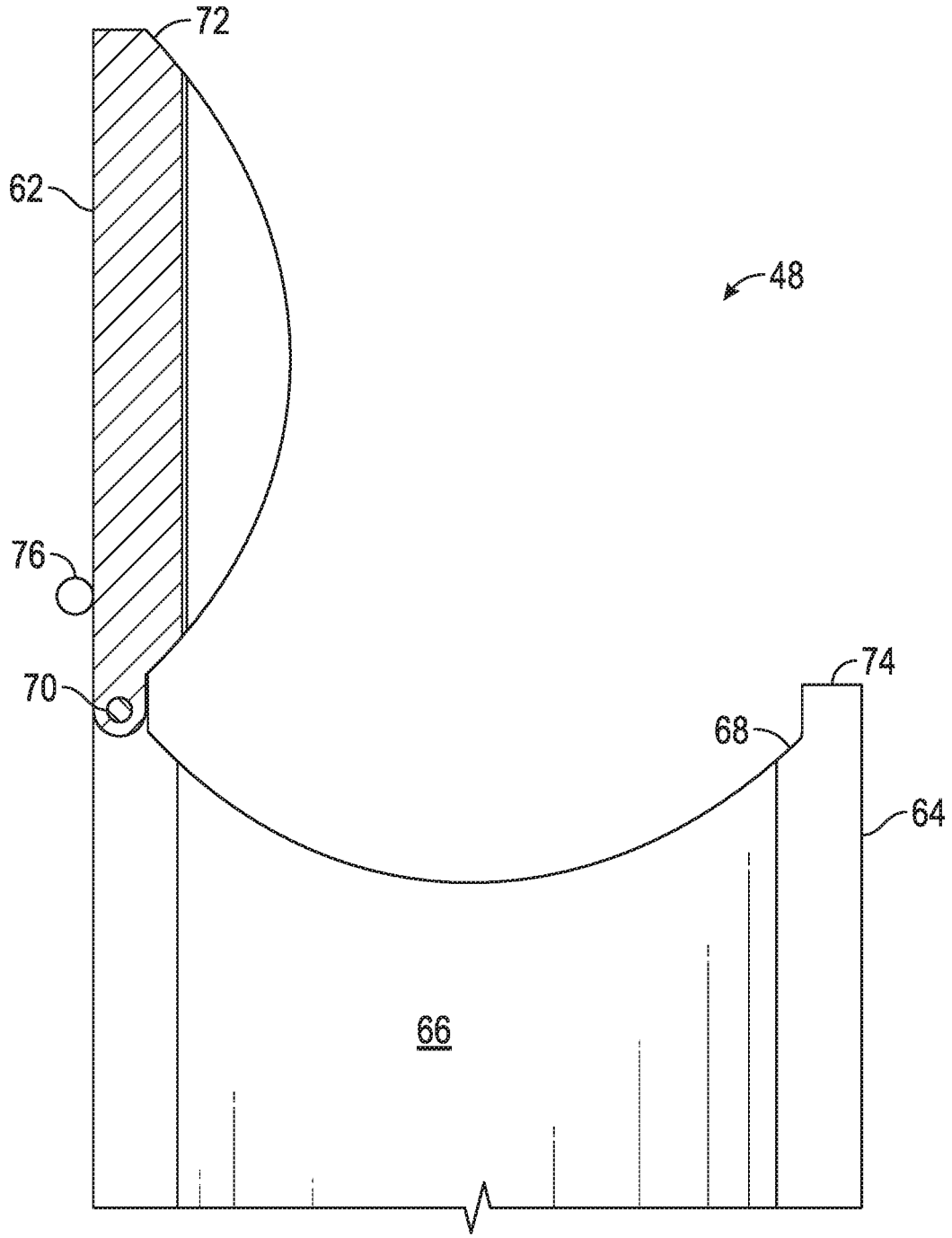
FIG. 2 is a cross-sectional illustration of an example of a flapper valve which may be utilized in a downhole system, according to an embodiment of the disclosure.

Referring generally to FIG. 2, an example of flapper 62 is illustrated and is of the type that may be mounted along tubing 44. In this embodiment, the flapper 62 is pivotably mounted along a flapper housing 64 having an internal passage 66 therethrough and having a hard sealing surface 68. The flapper 62 is pivotably coupled to the flapper housing 64 for movement between an open position and a closed position. By pivotably coupled, it should be understood the flapper 62 may be directly coupled to housing 64 or indirectly coupled to the housing 64 via an intermediate member.

In the illustrated example, flapper 62 is pivotably coupled via a hinge 70, e.g. a pivot pin. Additionally, the hard sealing surface 68 is formed and oriented for cooperative sealing with a flapper sealing surface 72 so as to provide a seal when flapper 62 is pivoted to the closed position. In some embodiments, the hard sealing surface 68 may be located below an axially outlying surface 74 of the housing 64. Additionally, a biasing member 76, e.g. a torsion string, may be operationally connected between the flapper 62 and the flapper housing 64 so as to bias the flapper 62 toward the closed position.

Figure 3:
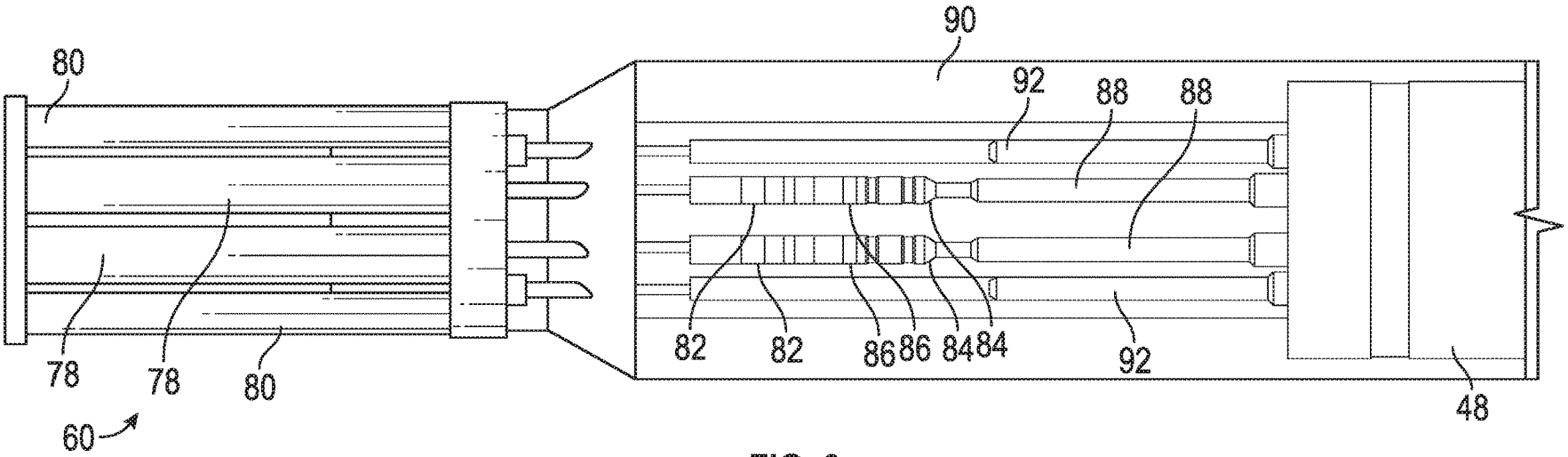
FIG. 3 is an illustration of an example of a leak-less electro-hydraulic actuation system having a closed loop hydraulic system, according to an embodiment of the disclosure.

Referring generally to FIG. 3, an example of the downhole hydraulic system 60 is illustrated. In this embodiment, the downhole hydraulic system 60 is a closed loop, metal enclosed, hydraulic system which may comprise an electric motor and pump enclosed in a pump housing 78 and coupled with suitable electronics enclosed in an electronic housing 80. As explained in greater detail below, the pump may be operated to provide hydraulic input to a piston 82 which, in turn, is coupled to an actuator rod 84 which may be coupled to a suitable actuator mechanism of downhole device/valve 48. It should be noted FIG. 3 illustrates a redundant system having a plurality of pump housings 78, e.g. two pump housings, and a plurality of electronic housings 80, e.g. two electronic housings, with associated redundancies in other components. However, many applications need not have such redundancy and can utilize a singular pump housing 78, singular electronics housing 80, and singular associated components.

In this example, an accumulator 86, e.g. an accumulator spring, is disposed between the piston 82 and the actuator rod 84 such that the piston 82 does not directly push against the actuator rod 84. A bellows 88 may be suitably attached, e.g. welded, about the actuator rod 84 and within a valve body 90 to create a fully enclosed metal cavity. If, for example, leaks occur across a piston seal the hydraulic fluid, e.g. oil, will be contained by the bellows 88.

Referring again to FIG. 3, the bellows 88 may be placed in fluid communication with a second bellows 92, e.g. a compensating bellows, via a suitable passage such as a gun drilled hole. The second bellows 92 serves as a seal and as a compensating device to accommodate, for example, thermal expansion of hydraulic oil and pressure compression of the hydraulic oil. The second bellows 92 also may be directly connected to the back of the pump and may be utilized as an oil reservoir. Thus, if a hydraulic oil leak occurs, the oil will be directed back to a pump input so that it may be pumped back into use for shifting piston 82. The bellows 88, 92 and their attachment mechanisms may be metal to enable construction of a closed-loop, metal enclosed, hydraulic system 60 for this embodiment and other embodiments described herein.

Figure 4:
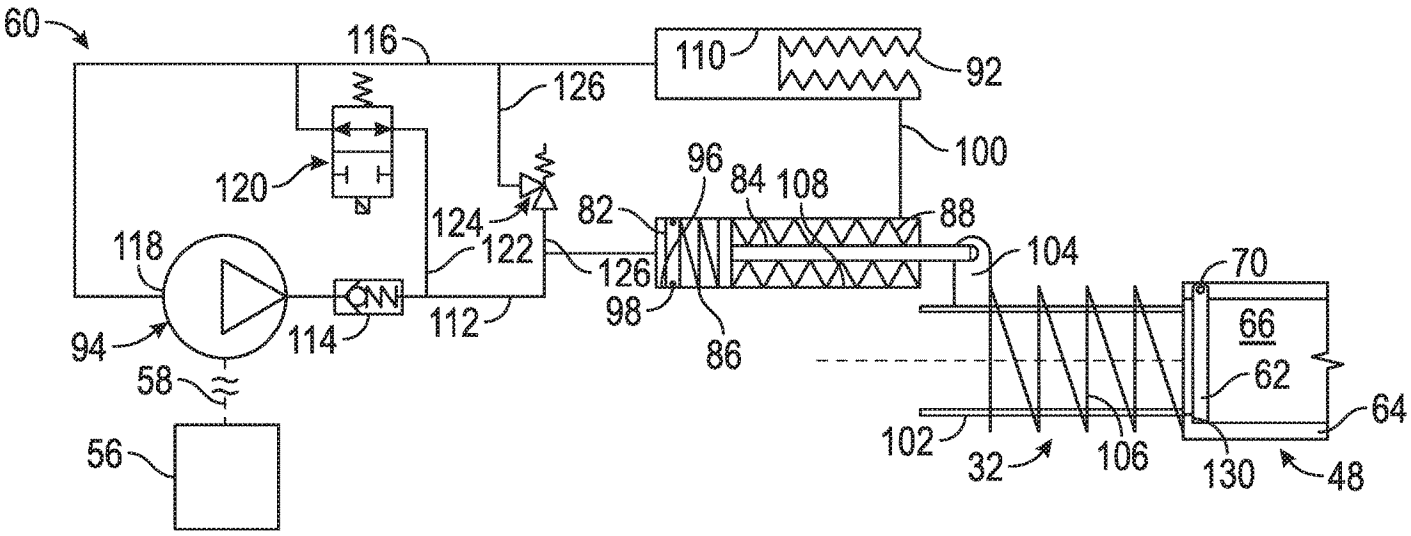
FIG. 4 is a schematic illustration of an example of an electro-hydraulic actuation system, according to an embodiment of the disclosure.

Referring generally to FIG. 4, a schematic embodiment of a closed loop hydraulic system 60 is illustrated. The hydraulic system 60 may be controlled via, for example, electrical inputs provided by control system 56 to suitable electronics 80 coupled with components of system 60. In this example, the closed loop hydraulic system 60 comprises a pumping assembly 94 which is coupled with and controlled via control system 56. For example, control system 56 may provide electrical signals to the pumping assembly 94 and to other components of the hydraulic system 60 so as to cause controlled actuation of downhole tool 32, e.g. opening and closing of flapper 62.

By way of example, the pumping assembly 94 may comprise a suitable pump powered by an electric motor which receives power and/or control signals via control line 58. The motorized pumping assembly 94 may utilize an electro-hydraulic pump, motor-pump assembly, piezo pump assembly, or other suitable motorized pumping assembly. Operation of pumping assembly 94 enables the delivery of hydraulic fluid, e.g. hydraulic oil, to piston 82 which may be coupled with piston rod 84 via accumulator spring 86.

The piston 82 is disposed within a pressure chamber 96, e.g. a cylinder, and slidably sealed with respect to an inside surface of cylinder 96 via a seal 98. The accumulator spring 86 may be a relatively stiff spring formed by, for example, a Belleville stack or other suitable spring member. The rod bellows 88 is disposed around piston rod 84, as illustrated, and placed in fluid communication with compensating bellows 92 via communication passage 100.

Additionally, the piston rod 84 is connected with an actuator member 102, e.g. a flow tube, via a connection mechanism 104. In the example illustrated, a power spring 106 may be positioned between valve housing 64 and actuator member 102 in a manner which biases the actuator member 102 away from housing 64 to enable closure of flapper 62. In some embodiments, the power spring 106 may be in the form of a coil spring disposed around the actuator member/flow tube 102 between housing 64 and connection mechanism 104. However, the power spring 106 may comprise a pressurized fluid chamber or another type of mechanism able to provide the desired bias.

It should be noted the rod bellows 88 is contained within a chamber 108 and the compensating bellows 92 is contained within a compensating bellows chamber 110. The communication passage 100 is routed between chamber 108 and chamber 110 so as to provide a completely enclosed, leak-proof system.

As further illustrated, the pumping assembly 94 may be placed in fluid communication with pressure chamber/cylinder 96 and piston 82 via a hydraulic line 112. In the example illustrated, a check valve 114 is positioned along the hydraulic line 112. During operation of pumping assembly 94, hydraulic fluid under pressure is delivered into pressure chamber 96. The check valve 114 ensures that pressurized hydraulic fluid does not return along hydraulic line 112 once the pumping assembly 94 is turned off. In other words, the check valve 114 helps maintain pressure in the pressure chamber/cylinder 96.

Additionally, a return hydraulic line 116 is connected between chamber 110 and an inlet side 118 of pumping assembly 94. According to the example illustrated, a normally open solenoid valve 120 may be disposed along a connecting hydraulic line 122 which extends between hydraulic line 112 and return hydraulic line 116. The normally open solenoid valve 120 enables control over the bleeding of pressure from the pressure chamber 96. The solenoid valve 120 may be set up as a fail-safe device which will fail to an open position which defaults to closure of the valve 48, e.g. closure of flapper 62.

Additionally, a high-pressure activated bleed valve 124 (or bleed valves) may be placed in fluid communication with hydraulic line 112 and return hydraulic line 116 via hydraulic lines 126. The bleed valve 124 functions to avoid building too much pressure in the pressure chamber 96.

To facilitate operation, the accumulator spring 86 may be stiffer than the power spring 106. When the flapper 62 (or other valve member) is actuated to a fully open position, the power spring 106 and the accumulator spring 86 may be compressed. If a leak of hydraulic fluid moves past piston 82, the hydraulic fluid migrates into bellows chamber 108 which is fully enclosed by the rod bellows 88.

As described above, the bellows chamber 108 may be connected to the hydraulic fluid reservoir provided by compensating bellows chamber 110 such that pressure differentials do not occur between rod bellows 88 and compensating bellows 92. The system construction also ultimately controls the pressure differential on rod 84 as well. Thus, both bellows 88, 92 see little or no pressure differential. Additionally, because the system is closed no hydraulic fluid, e.g. hydraulic oil, is lost to the external environment. In other words, hydraulic fluid/oil which leaks past piston 82 is able to migrate to chamber 108 and then to compensating bellows chamber 110. Oil within bellows chamber 110 is able to flow back to pumping assembly inlet 118 via return hydraulic line 116. Thus, if a pressure/oil leak past piston 82 occurs, the pumping assembly 94 may simply be actuated, e.g. turned on, without loss of hydraulic fluid to the environment. Additionally, the accumulator spring 86 enables a less frequent actuation of the pumping assembly 94 while also helping to maintain sufficient force against the piston rod 84.

Figure 5:
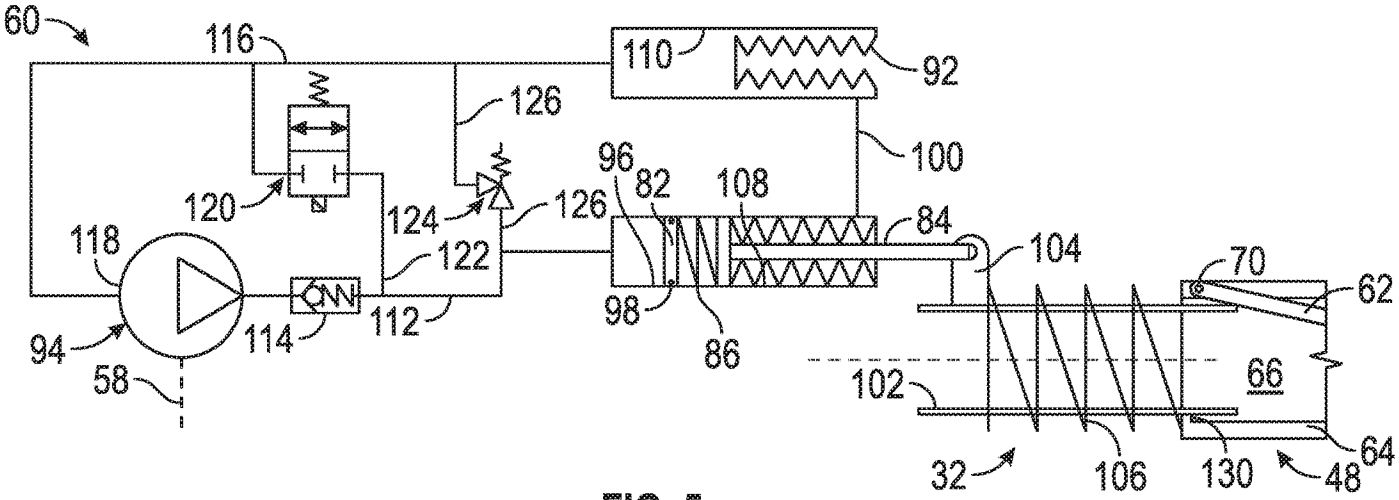
FIG. 5 is a schematic illustration similar to that of FIG. 4 but in a different operational position, according to an embodiment of the disclosure.

According to an operational example, the valve 48 may initially be in a closed position as illustrated in FIG. 4. To open valve 48, the solenoid valve 120 is powered and actuated to a closed position under the direction of control system 56, as illustrated in FIG. 5. The control system 56 also may be used to turn on pumping assembly 94 so as to initiate pumping of hydraulic fluid through check valve 114.

The pumping of hydraulic fluid causes an increase in pressure within pressure chamber 96 which, in turn, causes the piston 82 to push against the accumulator spring 86. The accumulator spring 86 is pushed against the rod 84 with sufficient force to shift the actuator member 102 which in this example is a flow tube. As the flow tube 102 is shifted, the power spring 106 is compressed and the flapper 62 is opened.

Figure 6:
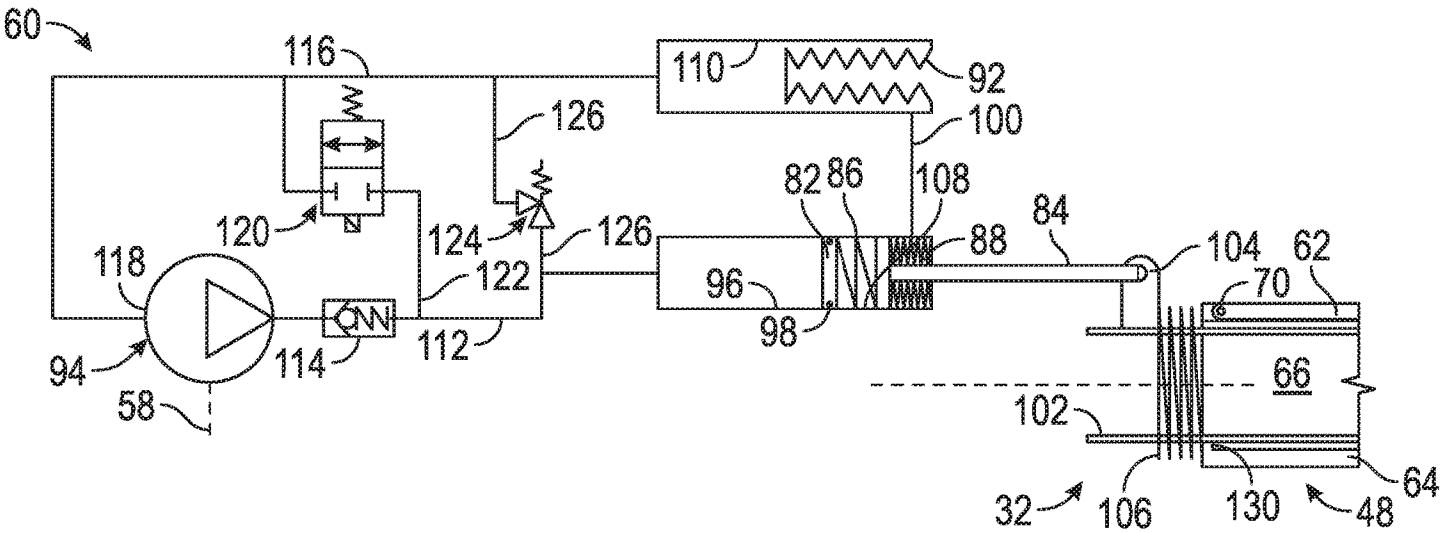
FIG. 6 is a schematic illustration similar to that of FIG. 5 but in a different operational position, according to an embodiment of the disclosure.

Movement of the piston 82 and the rod 84 causes bellows 88, e.g. a metallic bellows, to compress and the hydraulic fluid in bellows chamber 108 is forced through passage 100 and into compensation bellows chamber 110. The movement of hydraulic fluid into chamber 110 may cause compensation bellows 92, e.g. a metallic compensation bellows, to compress. While pumping assembly 94 is operated, pressure continues to build up in the pressure chamber 96 until piston 82 is displaced to the end of its stroke and bellows 88 is compressed as illustrated in FIG. 6.

If operation of pumping assembly 94 continues, the pressure may continue to build up in the pressure chamber 96 which causes compression of accumulator spring 86. The bleed valve 124, e.g. relief valve, is able to bleed off pressure when a maximum pressure is reached. The pumping assembly 94 may then be stopped under, for example, the direction of control system 56.

Figure 7:
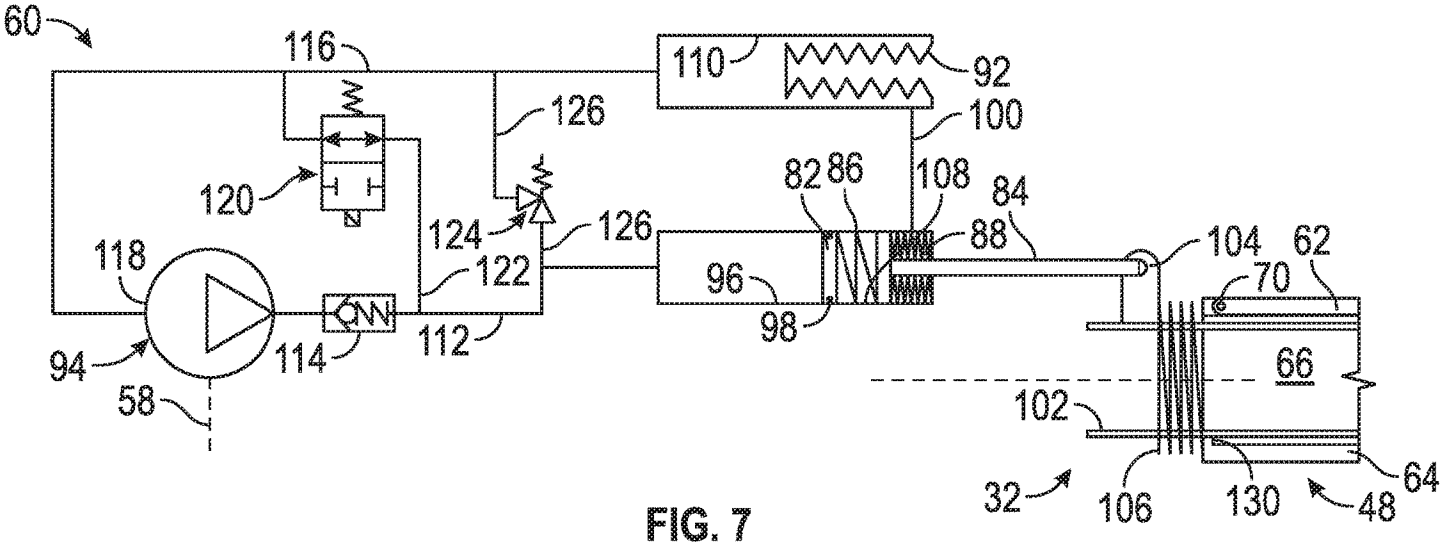
FIG. 7 is a schematic illustration similar to that of FIG. 6 but in a different operational position, according to an embodiment of the disclosure.

To close the valve 48, the solenoid valve 120 is unpowered which causes the solenoid valve 120 to shift to an open flow position, as illustrated in FIG. 7. Once the solenoid valve 120 is in the open flow position, the pressure level in pressure chamber 96 begins to lower which discharges the accumulator spring 86 (see FIG. 7). The pressure continues to lower in the pressure chamber 96, thus allowing the piston rod 84 and piston 82 to be moved back toward their original position under the biasing force of power spring 106.

Figure 8:
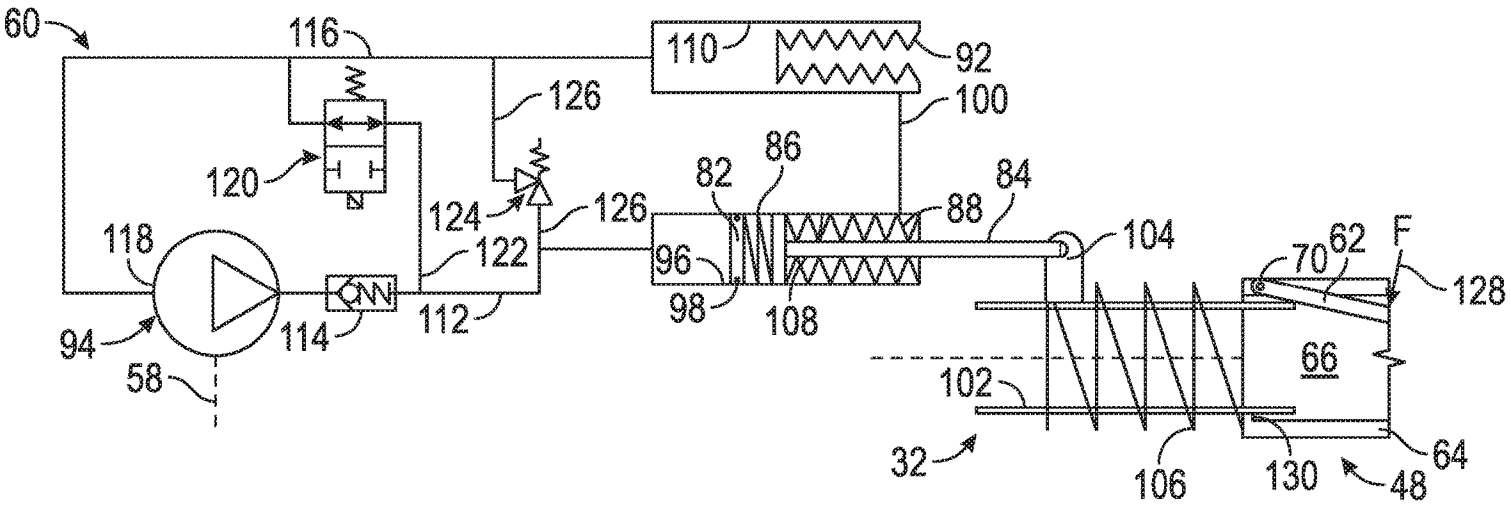
FIG. 8 is a schematic illustration similar to that of FIG. 7 but in a different operational position, according to an embodiment of the disclosure.

The flapper 62 may be biased towards a closed position by spring 76 (see FIG. 2) and/or by the force of fluid flow along interior 66 as represented by arrow 128 in FIG. 8. The movement of piston rod 84 may create a pressure increase that can be attenuated by compression of the accumulator spring 86. As the piston rod 84 and piston 82 are shifted back, the bellows 88 expands and a corresponding expansion of compensation bellows 92 occurs as hydraulic fluid is displaced through passage 100.

Figure 9:
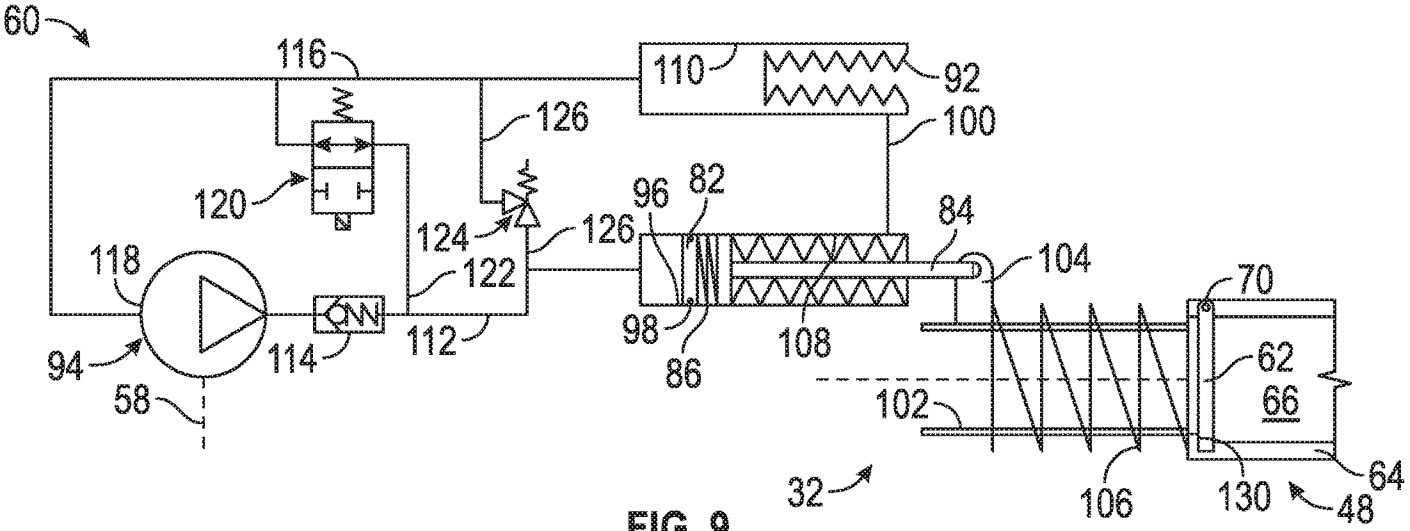
FIG. 9 is a schematic illustration similar to that of FIG. 8 but in a different operational position, according to an embodiment of the disclosure.

With fluid flow through interior 66, the flow acting on flapper 62 helps to continue pushing the flow tube 102 towards a closed position. In some applications, the pressure acting on flapper 62 may help maintain the accumulator spring 86 in at least a partially charged position. The compensating bellows 92 continues to expand as the hydraulic fluid, e.g. oil, is displaced from chamber 110 to chamber 108 via passage 100. This process may continue until the flapper 62 is fully closed against a suitable stop 130 as illustrated in FIG. 9. At this stage, the pressure may be fully bled until chambers 108, 110 are in communication at tubing pressure.

Figure 10:
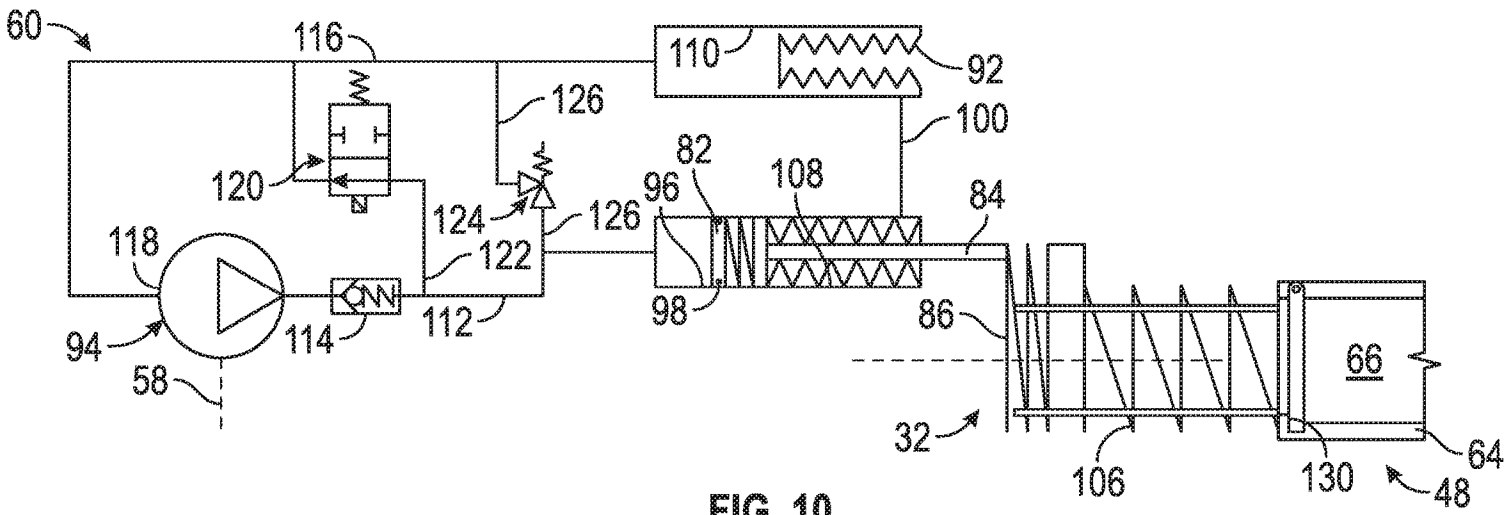
FIG. 10 is a schematic illustration of another example of an electro-hydraulic actuation system, according to an embodiment of the disclosure.

According to another embodiment, the accumulator spring 86 may be positioned between the piston rod 84 and the flow tube 102, as illustrated in FIG. 10. In this example, the accumulator spring 86 may be removed from chamber 108 such that piston 82 acts directly against piston rod 84. This type of embodiment may be employed to help minimize the piston stroke and so that a wider variety of accumulator springs 86 may be used instead of, for example, the Belleville stack or other internal spring member.

Figure 11:
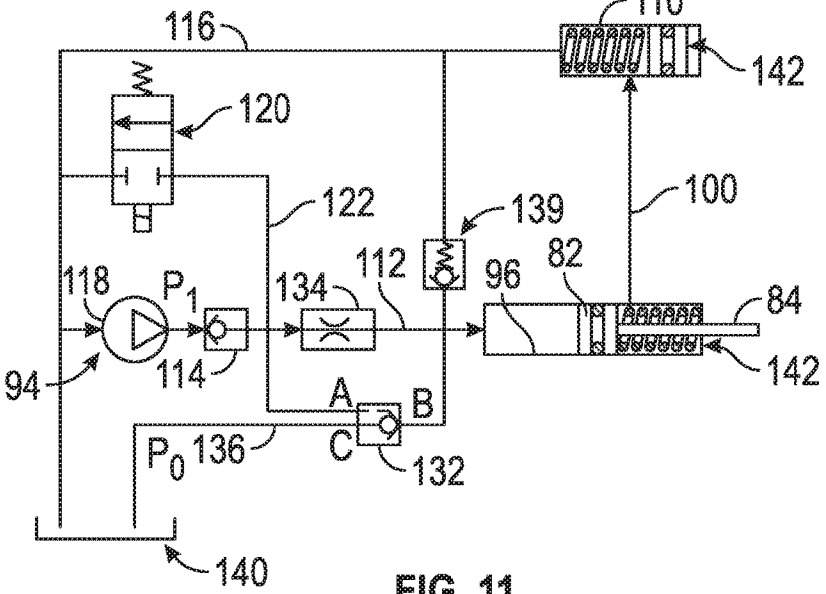
FIG. 11 is a schematic illustration of another example of an electro-hydraulic actuation system, according to an embodiment of the disclosure.
Figure 12:
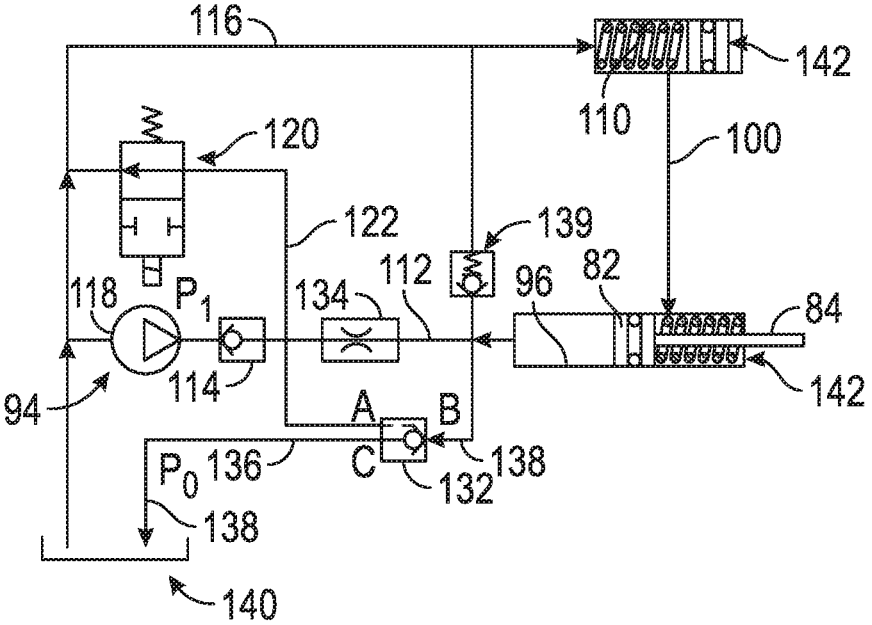
FIG. 12 is an illustration similar to that of FIG. 11 but in a different operational position, according to an embodiment of the disclosure.
Figure 13:
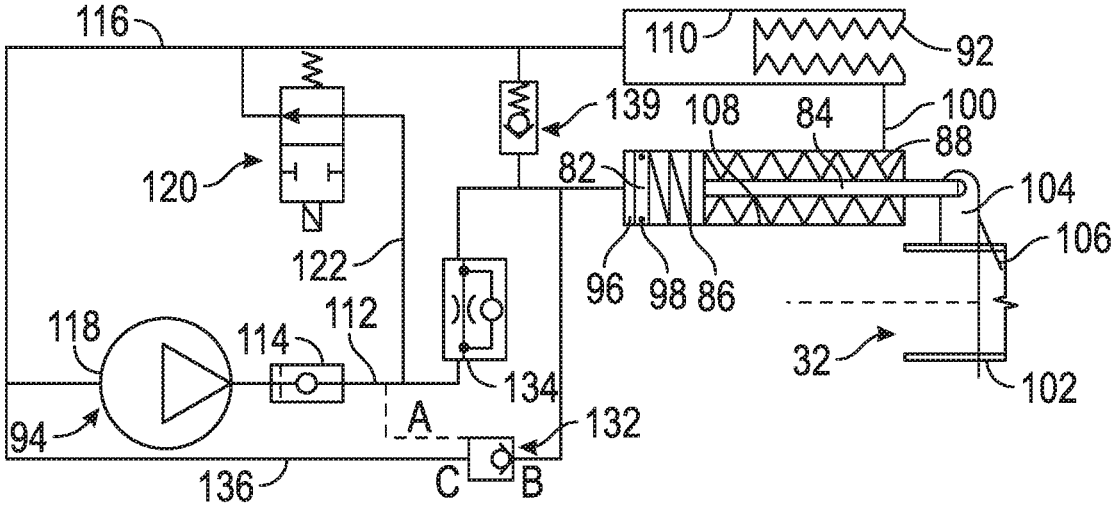
FIG. 13 is a schematic illustration of another example of an electro-hydraulic actuation system, according to an embodiment of the disclosure.

Referring generally to FIGS. 11-13, another embodiment of hydraulic system 60 is illustrated. In this example, a high flow pilot valve 132 is located in parallel with hydraulic line 112 and a flow restriction 134 is positioned along the hydraulic line 112 downstream of check valve 114 as illustrated in FIG. 11. The flow restriction 134 is placed in parallel to enable creation of a sufficiently large differential pressure between the appropriate ports of pilot valve 132. In this example, the sufficiently large differential pressure is created between pilot port C and pilot port B so as to cause a rapid opening of the pilot valve 132 and rapid bleeding through hydraulic line 136, as represented by arrows 138 in FIG. 12. The pilot valve 132 may be coupled with hydraulic line 112 and with return line 116 across a check valve 139 having a relatively high crack pressure, e.g. 3000 psi or other suitable level.

This type of arrangement is effective for use in situations having the potential for gas slam conditions in which too much pressure builds up without adequate bleeding capacity. The hydraulic fluid bled through hydraulic line 136 may be delivered to a reservoir 140 and/or back to pumping assembly inlet 118, as illustrated in FIG. 13. It should be noted the embodiment illustrated in FIGS. 11 and 12 utilizes spring and piston arrangements 142 in chambers 108, 110 while the embodiment illustrated in FIG. 13 uses bellows 88, 92 as described above.

Figure 14:
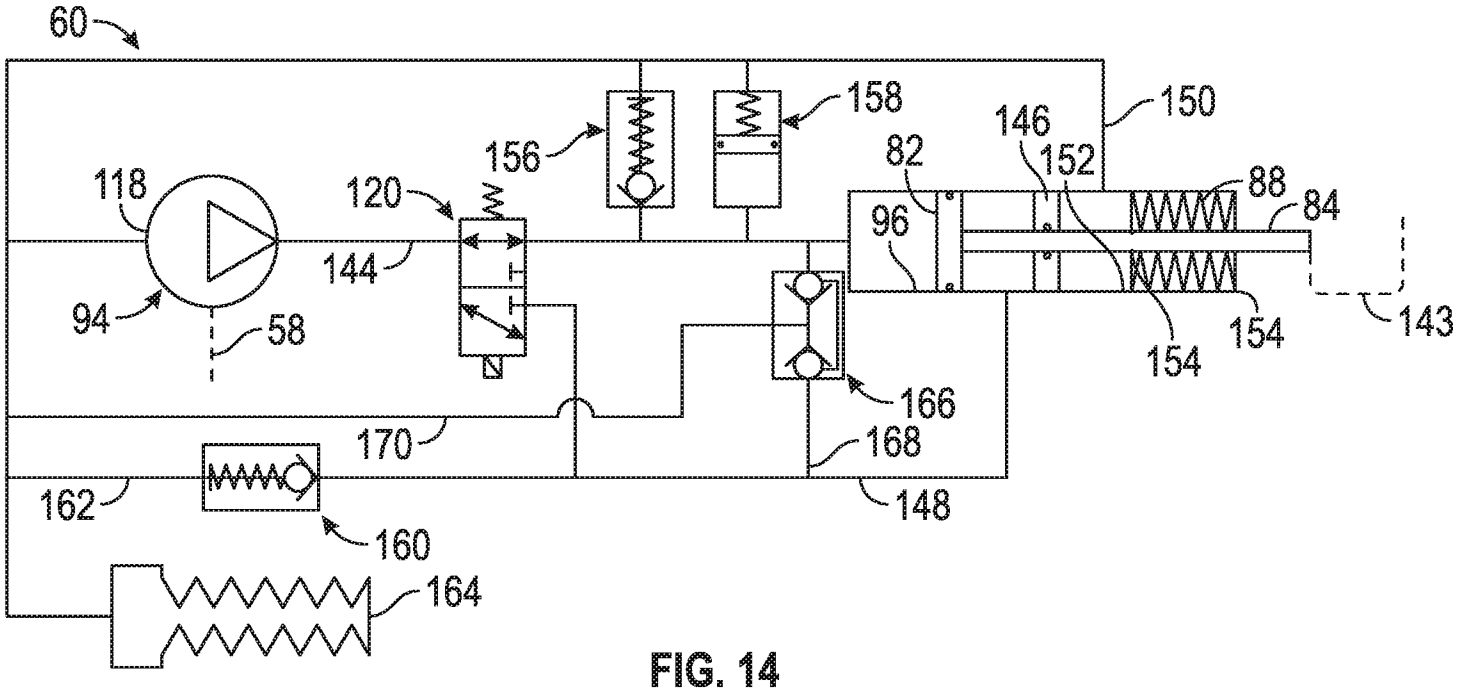
FIG. 14 is a schematic illustration of another example of an electro-hydraulic actuation system, according to an embodiment of the disclosure.
Figure 15:
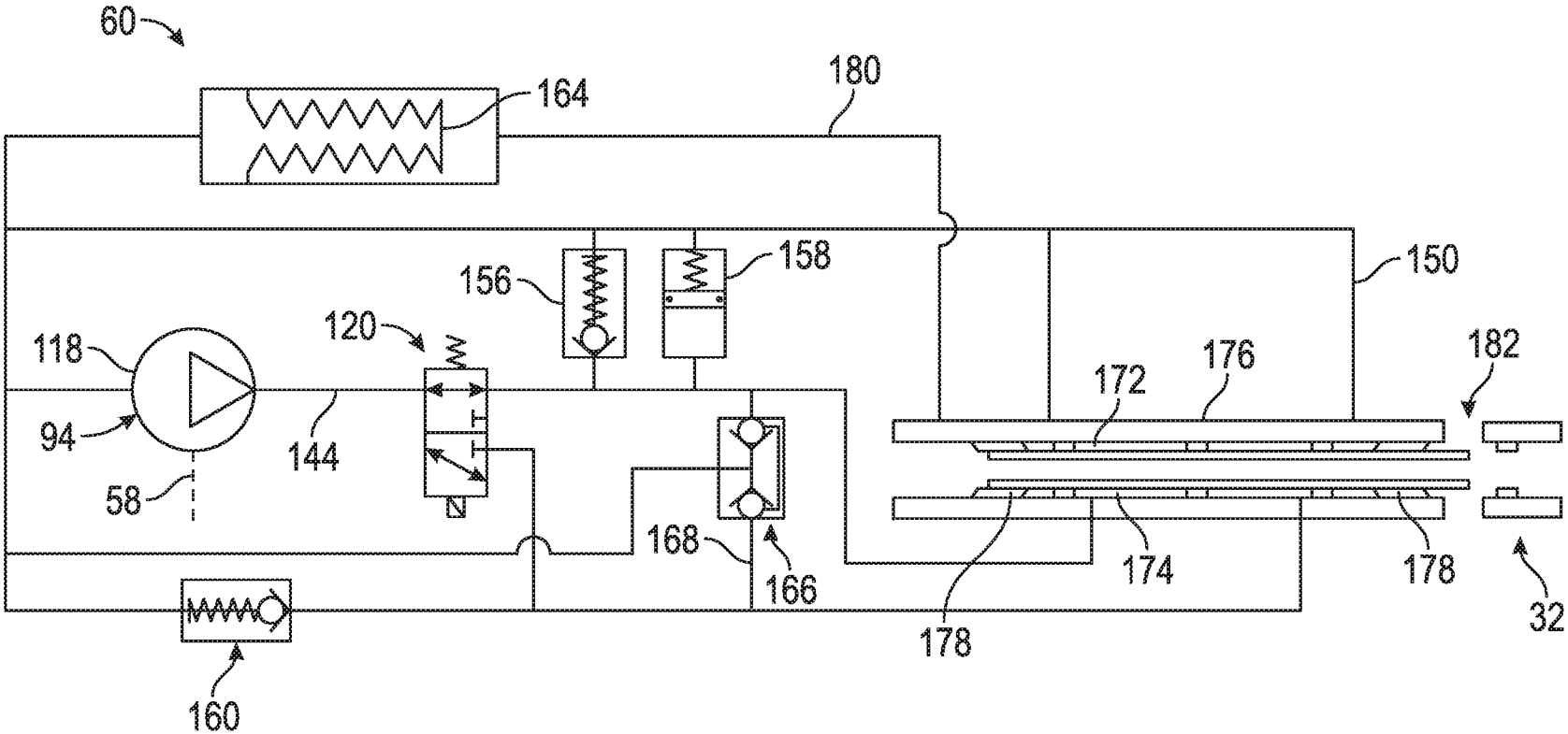
FIG. 15 is a schematic illustration of another example of an electro-hydraulic actuation system, according to an embodiment of the disclosure.

Referring generally to FIGS. 14 and 15, additional embodiments of hydraulic system 60 are illustrated. As with other embodiments, these embodiments provide an electro-hydraulic actuator suitable for a variety of applications in the oil and gas industry, including permanent applications. As with other embodiments described herein, the electrically controlled hydraulic system 60 may be constructed as completely enclosed by metal materials without having elastomeric seals exposed to well fluid.

In FIG. 14, an embodiment of a closed loop hydraulic system is illustrated which may be electrically controlled via control system 56. As with other embodiments described herein, this embodiment of hydraulic system 60 may be used to actuate various types of valves and other devices, such as a formation isolation valve 143, as shown in FIG. 14, for example. As another example, the closed loop hydraulic system 60 shown in FIG. 14 may be used to actuate an inflow control valve in place of or in addition to the formation isolation valve 143. The control system 56 may be used to provide appropriate signals to the motorized pumping assembly 94, solenoid actuated valve 120, and/or other electrically controlled components of hydraulic system 60.

In this example, the pumping assembly 94 is coupled with pressure chamber 96 via a hydraulic line 144 and solenoid valve 120 is disposed along the hydraulic line 144. The solenoid valve 120 may be selectively actuated via control system 56 to enable two-way actuation of piston 82. According to an embodiment, for example, piston 82 may be connected directly to piston rod 84 and piston rod 84 may be sealably and slidably mounted in a support structure 146. An additional hydraulic line 148 is connected between solenoid valve 120 and pressure chamber 96 on an opposite side of piston 82, i.e. between piston 82 and sealed support structure 146. When solenoid valve 120 is actuated to a second position, hydraulic actuating fluid from pump assembly 94 is directed through hydraulic line 148 to the pressure chamber 96 on an opposite side of piston 82 so as to drive rod 84 in an opposite direction.

A return hydraulic line 150 is connected to a chamber 152 containing rod bellows 88 on an opposite side of support structure 146. As with other embodiments, hydraulic fluid, e.g. oil, which reaches chamber 152 can be returned to pump assembly inlet 118 via return line 150. In this embodiment and other embodiments described herein, the bellows, e.g. bellows 88, 92, may be constructed of metal. According to the example illustrated, the bellows 88 is sealed and secured to rod 84 and to the structure defining chamber 152 via welds 154. However, other suitable attachment techniques and mechanisms may be utilized, e.g. brazing.

Referring again to FIG. 14, a check valve 156 and a spring accumulator 158 may be coupled between hydraulic line 144 and return line 150 to enable bleeding and/or relief of excess pressure. Similarly, a check valve 160 may be placed in communication with hydraulic line 148 via a relief hydraulic line 162. Both return hydraulic line 150 and relief hydraulic line 162 may be placed in fluid communication with a compensating bellows 164 as illustrated.

It should be noted a dual bleed valve 166 may be connected with hydraulic lines 144, 148 via hydraulic line 168 and with the inlet side of pumping assembly 94 via hydraulic line 170 as illustrated. The dual bleed valve 166 works in cooperation with pressure chamber 96 and check valves 156, 160 to enable bleeding of fluid and thus shifting of piston 82 during actuation of a given downhole tool 32 via rod 84.

As with the other embodiments described, the bellows may again be constructed from metal to provide a metal enclosed electro-hydraulic system. It should be further noted the components of hydraulic system 60 may be arranged in various configurations. For example, the pumping assembly 94 may comprise a combined electric motor-pump assembly which is coupled with a manifold along with solenoid actuated valve 120. In this arrangement, the manifold may comprise various other features, such as the check valves, relief valves, shuttle valves or other valves of the hydraulic system 60. Additionally, the control system 56 may be connected with the motor-pump assembly 94, solenoid actuated valve 120, and/or other valves via various types of electrical cables, conductor arrangements, or other signal carriers to enable electrical control over hydraulic system 60.

In FIG. 15, another embodiment of electrically actuated hydraulic system 60 is illustrated. This embodiment also may be constructed as a metal enclosed, closed-loop system able to prevent hydraulic fluid leaks. This embodiment is very similar to the embodiment described with reference to FIG. 14. However, the piston pressure chamber 96 is provided in an annular space 172 located between a sleeve type valve piston 174, a surrounding valve housing 176, and a pair of bellows 178 as illustrated.

Additionally, the compensating bellows 164 is exposed to tubing pressure via, for example, hydraulic line 180. In this example, the piston pressure chamber 96/annular space 172 also may be exposed to tubing pressure. As with the embodiment illustrated in FIG. 14, this embodiment again enables dual direction actuation of the valve piston. By way of example, the downhole tool 32 may be in the form of a choke 182 although the downhole tool 32 may be constructed with various other configurations, e.g. a surface controlled formation isolation valve, a full bore flow control valve, or other types of flow control devices.

Figure 16:
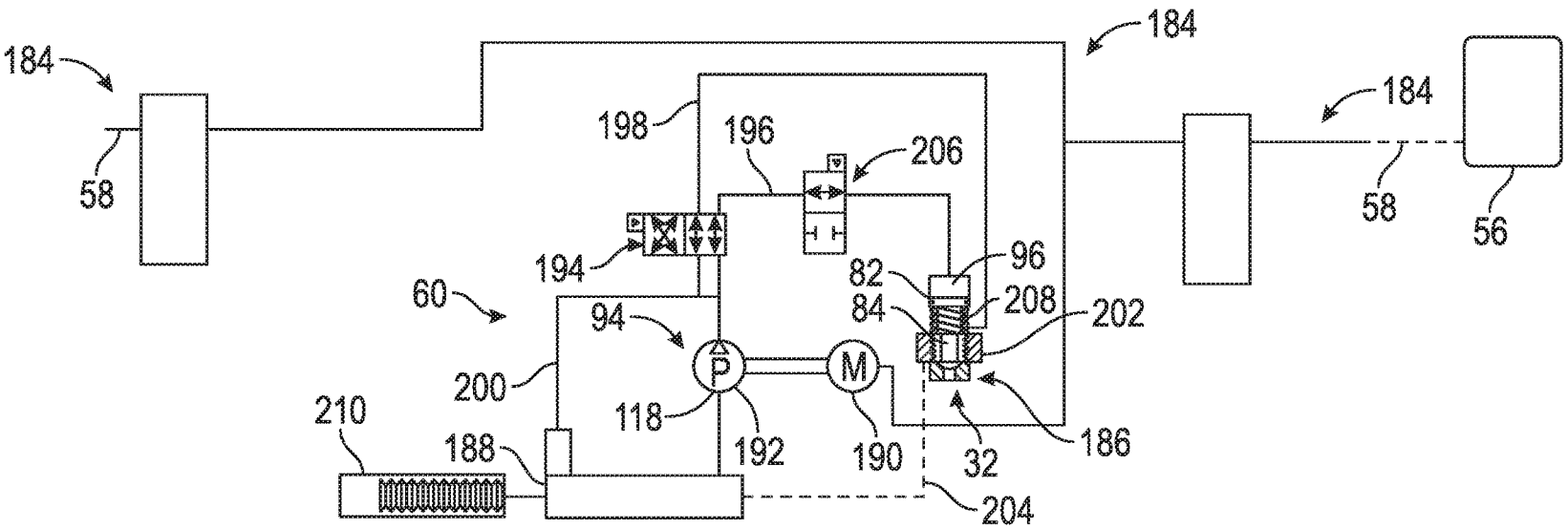
FIG. 16 is a schematic illustration of another example of an electro-hydraulic actuation system, according to an embodiment of the disclosure.
Figure 17:
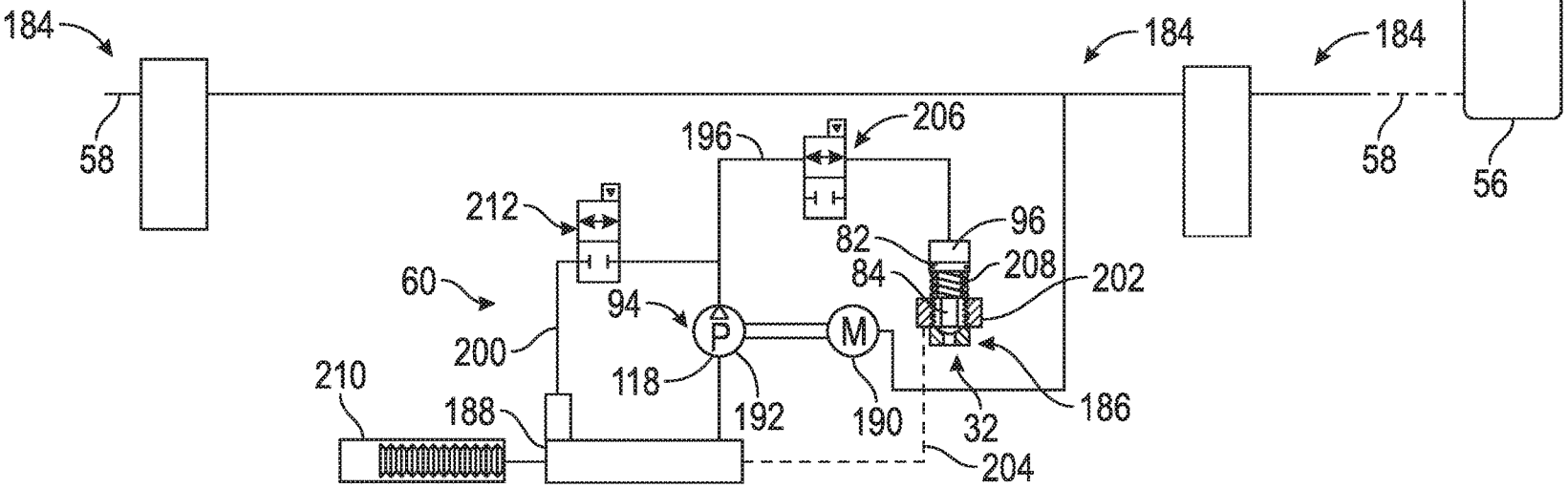
FIG. 17 is a schematic illustration of another example of an electro-hydraulic actuation system, according to an embodiment of the disclosure.

Referring generally to FIGS. 16 and 17, additional embodiments of electrically controlled hydraulic system 60 are illustrated. In the embodiment of FIG. 16, each hydraulic system 60 may be controlled according to signals provided by control system 56 via control line 58. By way of example, a plurality of the hydraulic systems 60 may be used in a plurality of well zones 184 distributed along a horizontal wellbore 36 or other type of borehole. Depending on the application, each hydraulic system 60 may be constructed as a closed loop system to avoid leakage of hydraulic actuating fluid.

Although the downhole tool/device 32 may have a variety of configurations, the illustrated example shows device 32 in the form of an inflow control valve 186 used to control flow of well fluid into tubing string 42 at each well zone 184. In the embodiment illustrated in FIG. 16, hydraulic fluid (e.g. oil) is supplied to pumping assembly 94 from a reservoir 188. As with other embodiments described herein, the pumping assembly 94 may comprise a combined electric motor 190 and pump 192.

A suitable valve 194, e.g. a solenoid actuated valve, may be used to direct the hydraulic actuating fluid to pressure chamber 96 and piston 82 along one of the hydraulic lines 196, 198. For example, when solenoid valve 194 is in a first position, hydraulic fluid is directed along hydraulic line 196 to shift piston 82 and to actuate inflow control valve 186 to a closed flow position. During actuation, hydraulic fluid from the other side of piston 82 is bled through hydraulic line 198 and back into reservoir 188 via a return line 200.

When the solenoid valve 194 is actuated to a second position, hydraulic fluid is directed along hydraulic line 198 to shift piston 82 in the opposite direction and to actuate inflow control valve 186 to an open flow position. During this actuation, hydraulic fluid from the other side of piston 82 is bled through hydraulic line 196 and back into reservoir 188 via return line 200. In some applications, a bellows 202 may be positioned around the actuator/rod 84 so as to capture potential leaks of hydraulic fluid and to return the fluid to reservoir 188 via a return line 204.

Additionally, a second solenoid actuated valve 206 (or other suitable valve) may be selectively actuated from a flow position to a flow blocking position so as to freeze the piston 82 and actuator/rod 84 at a desired position. This enables, for example, the inflow control valve 186 to be locked at a specific choke position. When the second valve 206 is shifted to the flow blocking position, hydraulic fluid is trapped under pressure in pressure chamber 96.

In this example, the rod 84 may serve as a plunger selectively adjusted to control the choke position of inflow control valve 186. The rod/plunger 84 may be spring biased in a desired direction via a spring 208. If pressure in the system is released, for example, the spring 208 may be oriented to shift the inflow control valve 186 to a fully open position while bleeding hydraulic fluid back into the reservoir 188. A compensator 210 may be coupled with reservoir 188 to compensate for volume changes due to, for example, changes in temperature and/or pressure. This type of closed system is able to provide substantial power for actuating the rod/plunger 84, thus enabling operation with a higher differential pressure across the valve 186 at a given choke position. The system also enables easy locking of the rod/plunger 84 at the desired choke position.

In FIG. 17, a similar embodiment to that of FIG. 16 is illustrated except the downhole device 32, e.g. inflow control valve 186, is single acting instead of dual acting. In this example, single hydraulic line 196 is used to shift the rod/plunger 84 and valve 186 toward a closed position. However, the rod/plunger 84 and valve 186 may be actuated toward an open position via spring 208.

When pressure is released in hydraulic line 196 and a solenoid valve 212 (positioned along return hydraulic line 200) is actuated to an open flow position, the spring 208 is able to shift piston 82 along with plunger/rod 84 toward the open position while fluid is bled back into reservoir 188. The solenoid actuated valve 206 may similarly be used to block flow along hydraulic line 196 and to thus lock piston 82 and plunger/rod 84 at a desired choke position.

Depending on the parameters of a given environment and wellbore application, the components utilized in the well system 30 may vary. The downhole device 32 may comprise many types of valves and other actuatable components utilized in vertical wellbores, horizontal wellbores, or other types and orientations of boreholes. Additionally, the control system 56 and communication line 58 may vary according to the characteristics of a given application and/or environment. In subsea applications, the control system 56 may be located on a surface facility or another suitable location. The electrically controlled downhole hydraulic system 60 and the components of that system may be selected according to the configuration of a given well system 30 and the parameters of a given environment and/or well operation, including subsea environments and subsea applications.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a tubing string deployed in a borehole, the tubing string having a downhole tool actuatable by a downhole hydraulic system, the downhole hydraulic system comprising a piston and an accumulator spring disposed in a pressure chamber, the piston coupled to the downhole tool via a rod to actuate the downhole tool between operational positions;

a pumping assembly hydraulically coupled with the pressure chamber;

a bellows system arranged to contain hydraulic actuating fluid in a metal enclosed loop within the downhole hydraulic system, the bellows system comprising:

a first sealed metal bellows disposed around the rod and within a bellows chamber; and a second sealed metal bellows fluidly coupled to the bellows chamber; and a control system coupled with the downhole hydraulic system via an electrical line to enable control over the downhole hydraulic system via electric signals.

2. The system as recited in claim 1, wherein the downhole tool comprises a valve.

3. The system as recited in claim 2, wherein the valve is a flapper valve.

4. The system as recited in claim 1, wherein the downhole tool comprises at least one valve.

5. The system as recited in claim 1, wherein the pumping assembly comprises a pump operated by an electric motor to pump hydraulic fluid to the pressure chamber.

6. The system as recited in claim 1, wherein the control system is a surface control system.

7. The system as recited in claim 1, wherein the downhole hydraulic system comprises a solenoid valve actuatable to control bleeding of actuating fluid from the pressure chamber.

8. The system as recited in claim 1, wherein the downhole hydraulic system comprises a solenoid valve actuatable to selectively lock the piston and the downhole tool at a desired actuation position.

9. A method, comprising:

providing an electro-hydraulic actuation system having a downhole hydraulic system electrically controlled via a surface control system;

coupling the downhole hydraulic system with a downhole tool via a piston, an accumulator spring, and a piston rod;

locating a sealed bellows of a bellows system around the piston rod and within a bellows chamber of the bellow system;

fluidly coupling the bellows chamber with a compensating bellows of the bellow system;

utilizing the bellows system in the downhole hydraulic system to provide a leakproof, closed-loop hydraulic system for actuating the downhole tool, the leakproof, closed-loop hydraulic system being fully metal enclosed; and providing electric signals to the downhole hydraulic system to cause hydraulic actuation of the downhole tool to a desired operational position.

10. The method as recited in claim 9, wherein coupling comprises coupling the downhole hydraulic system with a valve.

11. The method as recited in claim 9, wherein coupling comprises coupling the downhole hydraulic system with a flapper valve.

12. The method as recited in claim 9, wherein coupling comprises coupling the downhole hydraulic system with an inflow control valve.

13. The method as recited in claim 9, wherein coupling comprises coupling the downhole hydraulic system with a formation isolation valve.

14. A system for use with a downhole tool, the system comprising:

a downhole hydraulic system having: a piston and an accumulator spring, disposed in a pressure chamber and the piston couplable to the downhole tool via a rod coupled to the piston;

a pumping assembly hydraulically coupled with the pressure chamber, the pumping assembly being electrically controllable; and a bellows system arranged to contain hydraulic actuating fluid in a closed loop within the downhole hydraulic system to avoid leakage of hydraulic actuating fluid to a surrounding environment, the bellows system comprising:

a first sealed metal bellows disposed around the rod and within a bellow chamber, and a second sealed metal bellows fluidly coupled to the bellows chamber.

15. The system as recited in claim 14, further comprising a control system coupled with the downhole hydraulic system via an electrical line to enable control over the downhole hydraulic system via electric control signals.

16. The system as recited in claim 14, wherein the pumping assembly comprises a pump operated by an electric motor to pump hydraulic fluid to the pressure chamber.

* * * * *